US006267831B1

(12) United States Patent
Yashiki

(10) Patent No.: US 6,267,831 B1
(45) Date of Patent: Jul. 31, 2001

(54) METHOD OF MAKING A TITANIUM OR TITANIUM ALLOY STRIP HAVING A DECORATIVE SURFACE APPEARANCE

(75) Inventor: Takashi Yashiki, Osaka (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/303,609

(22) Filed: May 3, 1999

(30) Foreign Application Priority Data

May 6, 1998 (JP) ..... 10-123651

(51) Int. Cl.[7] ..... C22F 1/18
(52) U.S. Cl. ..... 148/670; 148/671
(58) Field of Search ..... 148/670, 671

(56) References Cited

U.S. PATENT DOCUMENTS 4,643,939 * 2/1987 Sugiyama et al. ..... 428/283
5,759,307 * 6/1998 Berger et al. ..... 148/603

FOREIGN PATENT DOCUMENTS 5-222558 8/1993 (JP) .
6-10329 2/1994 (JP) .
8-291397 11/1996 (JP) .
8-296071 11/1996 (JP) .
9-3573 1/1997 (JP) .
9-143769 6/1997 (JP) .
9-157871 6/1997 (JP) .
9-157872 6/1997 (JP) .

OTHER PUBLICATIONS

Takashi Yashiki, "Current Advances in Materials and Processes", The Iron and Steel Institute of Japan, vol. 9, No. 6, 1996, 4 Pages (with English Abstract) No month data.
"Kinzoku", Metals and Technology, vol. 67, No. 2, 1997, 9 Pages (with English Abstract) No month data.

* cited by examiner

*Primary Examiner*—Roy King
*Assistant Examiner*—Nicole Coy
(74) *Attorney, Agent, or Firm*—Oblon, Spivak, McClelland, Maier, Neustadt, P.C.

(57) ABSTRACT

A method for making a titanium or titanium alloy strip or strips having homogeneous gloss between the strips and throughout the same strip comprises subjecting the strip or strips to a continuous annealing and pickling line or only in a pickling line, wherein the strip or strips are passed through a pickling vessel having an immersion roll plural times and are appropriately inverted at least once during the plural times.

16 Claims, 3 Drawing Sheets

METHOD OF MAKING A TITANIUM OR TITANIUM ALLOY STRIP HAVING A DECORATIVE SURFACE APPEARANCE

BACKGROUND OF THE INVENTION

1. Field of the Invention

This invention relates to the continuous manufacturer of a titanium or titanium alloy strip in a continuous processing line wherein annealing and pickling, or pickling alone is carried out, and more particularly, to a useful method for making a titanium or titanium alloy strip wherein gloss or glossiness is rendered homogeneous or uniform between different titanium strips or throughout the same titanium strip.

2. Description of the Prior Art

As the development of water front is now in progress and acidic rain is generated, an environment on buildings is beginning to turn severe in recent years. Moreover, a rise in maintenance cost has been experienced. Hence, attention has now been paid to maintenance-free building materials, which are excellent in corrosion resistance and long in lifetime. Under these circumstances, building materials consisting of titanium strips and titanium alloy strips (which may be sometimes referred generically as "titanium strip or strips") are recently used in steadily increasing amounts.

The main reason for this is that titanium has very good corrosion resistance and undergoes little corrosion in an atmospheric environment. Besides, one of factors, with which titanium is favored, is that it assumes a peculiar silver white color and various kinds of design properties can be imparted thereto by surface treatments. As titanium is increasing in its applications to buildings, diverse demands are created for surface design properties, and particularly, it is frequently required to appropriately control a surface gloss.

It is known that the surface finishing method of a pure titanium strip for building material is broadly classified into vacuum annealing finish and pickling finish. The titanium strip obtained by the vacuum annealing finish has an as-rolled surface texture and has a glittering feel, with a loss of a decorative appearance. In addition, gloss control is difficult, which often leads to the problem that a difference in gloss appears between the sites of an actual titanium strip article. In contrast to the vacuum annealing finish, the pickling finish is sometimes favored due to the fact that a surface gloss can be at a relatively low level, and thus, reflection of light can be suppressed as desired.

Where a titanium strip used as a pickling finish material is industrially obtained, usual practice is to use a continuous annealing and pickling line having such an arrangement as shown in FIG. 1. In this line, an atmospheric annealing furnace, a salt bath and a pickling bath are arranged in series, and a titanium strip is passed successively through these devices. As a result, a cold rolled titanium strip for building material can be continuously annealed and de-scaled. Among these steps, the atmospheric annealing is carried out for the purpose of removing the strain caused in the course of cold rolling and controlling the structure in order to obtain desired mechanical properties.

The immersion in the salt bath is for the purpose that the scale formed during the atmospheric annealing is more likely to be removed by pickling. The titanium strip obtained after the atmospheric annealing is immersed in a salt bath containing sodium hydroxide and sodium nitrate as main components at high temperatures of about 500° C., whereupon part of the scale is dissolved in the bath, and simultaneously, the scale is cracked due to thermal shock exerted thereon. Subsequently, pickling using hydrofluoric acid and nitric acid is performed, under which a pickling solution is impregnated in to the base metal through the cracks thereby causing the boundary between the scale and the base metal to be dissolved out. Eventually, the scale can be completely removed to provide metallic luster. Since the continuous annealing and pickling line has such multiple steps as set out above, the relationship between the treating conditions in the respective steps and the gloss has not been always fully made clear. Accordingly, it has been difficult to make a uniform gloss between titanium strips and also on or throughout the same titanium strip although not so difficult as in the case of the vacuum annealing finish. Thus, it is believed that any reliable technique of obtaining such a gloss as required by users has never been established.

For instance, Japanese Laid-open Patent Application No. Hei 8-296071 discloses a method of making a titanium material having a reduced gloss and a good anti-glazing property. However, this method has the problem that gloss cannot be made uniform between different titanium strips or throughout the same titanium strip. Further, in Japanese Laid-open Patent No. Hei 9-3573, there is disclosed a titanium material having good anti-glazing property and its manufacture. However, a uniform gloss cannot be obtained between different titanium strips or throughout the same titanium strip.

SUMMARY OF THE INVENTION

It is accordingly an object of the invention to provide a method for making a titanium strip in a continuous annealing and pickling line or in a pickling line alone, which overcomes the problems of the prior art counterparts.

It is another object of the invention to provide a method for making a titanium strip that has a homogeneous or uniform gloss between different titanium strips or throughout the same titanium strip.

The above objects can be achieved, according to one embodiment of the invention, by a method for making a titanium or titanium alloy strip, which comprises subjecting a titanium or titanium alloy strip to pickling finish according to a continuous annealing and pickling line or a pickling line wherein the titanium or titanium alloy strip is passed through a pickling vessel having a pickling roll plural times while inverting the strip in the vessel at least once during the plural time. The term "inverting" used herein is intended to mean that the upside of the strip is turned down in the vessel.

The above objects can also be achieved according to further embodiments of the invention which are summarized below as (1) to (3).

(1) When titanium or titanium alloy strips having different widths are subjected to pickling finish in a continuous annealing and pickling line or in a pickling line, the pickling finish is carried out in such a way that a difference in width between the preceding and succeeding strips is within a range of not more than 50% of the width of the preceding strip.

(2) When a titanium or titanium alloy strip is subjected to pickling finish in a continuous annealing and pickling line or a pickling line, the pickling finish is carried out in such a way that a titanium ion concentration in a pickling solution is within a range of not less than 0.1 g/liter.

(3) When a titanium or titanium alloy strip is subjected to pickling finish in a continuous annealing and pickling line or a pickling line, the pickling finish is carried out in such a way that an oxygen content in a furnace atmosphere in an annealing furnace is within a range of not lsee than 0.1 vol %.

The embodiments (1) to (3) may be used singly or, if necessary, in combination. For instance, the first-mentioned method of the invention may be carried out in combination with the embodiment (1). Likewise, the first-mentioned method of the invention may be carried out while satisfying the requirements of the embodiments (1) and (3). Moreover, the first-mentioned method of the invention may be performed while satisfying the requirements of the embodiments (2) and (3). As a matter of course, it is very effective to carry out the method of the invention while satisfying the requirements of all of the further embodiments (1) to (3).

DETAILED DESCRIPTION OF THE PREFERRED EMBODIMENTS

In order to achieve the above objects, we have made extensive studies on the relation between the operation state or conditions in a continuous annealing and pickling line or a pickling line and the gloss of a pickled coil or strip. As a result, it has been found that a titanium strip (or a titanium alloy strip), which is passed once through a continuous annealing and pickling line or a pickling line, has glosses that greatly differ from each other at opposite sides thereof. The reason for this is considered as follows.

Figure 2:
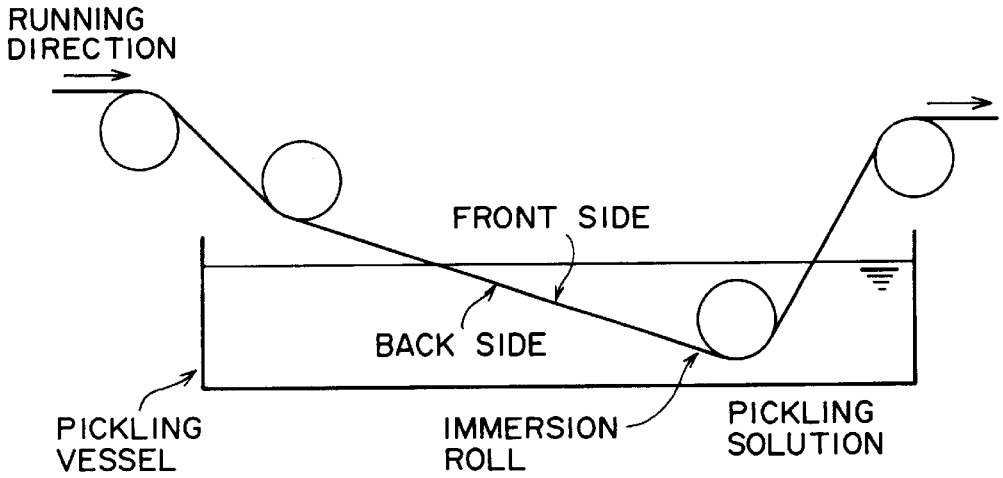
FIG. 2 is a schematic view illustrating the immersion of a coil in a pickling vessel.

The state of immersion of a titanium strip in a pickling vessel is particularly shown in FIG. 2. Because pickling conditions, such as a time of contact with a pickling solution (i.e. an immersion time) and an agitation time, differ at opposite sides of a titanium strip in the pickling solution, different degrees of pickling at the opposite sides result. This is considered to reflect on a difference in gloss at the opposite sides. For instance, it is usual that an immersion roll is arranged in the pickling vessel in order to immerse a titanium strip in the solution. However, as shown in FIG. 2, the front side of the titanium strip is in intimate contact with the immersion roll, the pickling time is correspondingly shortened. Accordingly, where a titanium strip is subjected to pickling finish in a continuous annealing and pickling line or in a pickling line, it is necessary that the strip be run through a pickling vessel having an immersion roll plural times, wherein the strip is run through the pickling vessel while appropriately inverting the strip in every running cycle. As a consequence, there can be obtained a titanium strip (or titanium alloy strip) having a decorative surface appearance and homogeneous gloss throughout opposite surfaces thereof.

Figure 3:
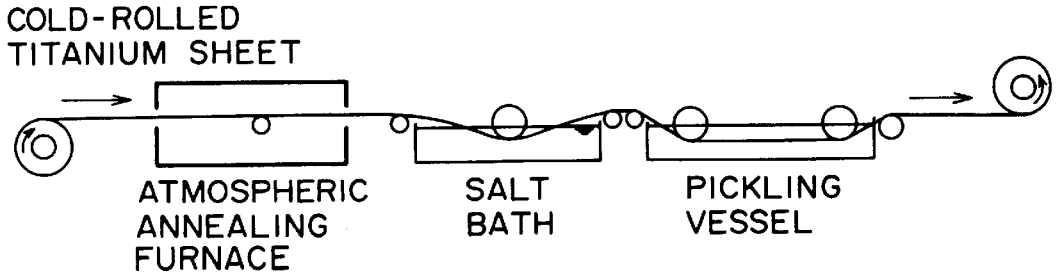
FIG. 3 is a schematic view illustrating the manner of reversing a titanium strip.

The manner of inverting a titanium strip is not critical. Typically, the inversion can be achieved by devising how to take up a titanium strip, after having once been passed through the pickling vessel, in the form of a coil. More particularly, as shown in FIG. 3, the titanium strip is taken up in a direction opposite to a titanium coil at the inlet side of a continuous annealing and pickling line (or a pickling line), and the resultant coil is transferred to the inlet side for a subsequent running cycle wherein the strip is again passed through the pickling vessel.

Figure 4:
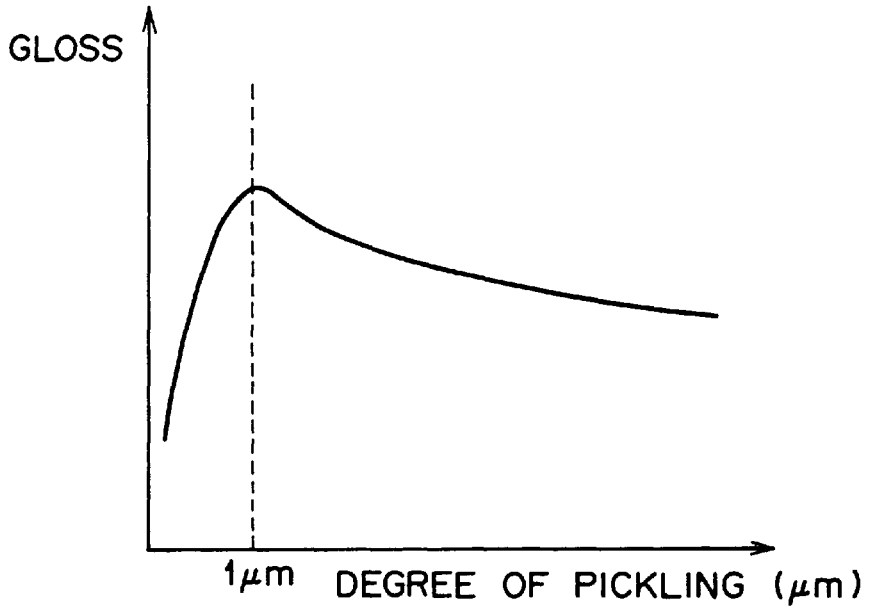
FIG. 4 is a graph illustrating the relation between the gloss and the degree of pickling.

The relation between the variation in gloss and the degree of pickling (i.e. a loss in strip thickness after pickling) is schematically shown in FIG. 4. The gloss increases at an initial stage of the pickling, followed by gentle variation thereof. Accordingly, after passing the titanium strip twice while turning the titanium strip invertedly, the strip is further passed so as to minutely control the gloss or remove scratches, whereupon there is not caused any great difference in gloss between the opposite sides of the titanium strip. As will be described in more detail, the gloss is influenced not only by the degree of pickling, but also by an average grain size. The graph shown in FIG. 4 is obtained using an average grain size of about 10 to 25 $\mu$m.

Further, we have found that where a plurality of titanium strips are continuously pickled in a continuous annealing and pickling line or in a pickling line, there can also be obtained a titanium strip having a decorative surface appearance with homogeneous gloss if the pickling finish is performed in such a way that a difference in width between the preceding strip and the succeeding strip is within a range of not more than 50% of the width of the preceding strip.

When the difference in the strip width exceeds 50%, an amount of oxygen in an annealing furnace greatly varies between the preceding and succeeding strips due to the difference in the amount of oxygen consumed through oxidation reaction, thus leading to a difference in denseness of scale. Eventually, ease in dropping the scale off by application of a pickling solution differs depending on the denseness, thus resulting in a difference in the degree of pickling between the coils or strips. In case where the difference in the strip width is too large, a reaction area varies greatly, so that the temperature of the pickling solution becomes different for every titanium strip. As a consequence, the degree of pickling differs in every titanium strip, thereby causing a gloss difference to be developed.

Further, the objects of the invention can also be achieved when using the following procedure according to a further embodiment of the invention. More particularly, when a titanium strip is subjected to pickling finish in a continuous annealing and pickling line, the titanium strip is treated such that a titanium ion concentration in a pickling solution is invariably held at a level of not less than 0.1 g/liter, thereby obtaining a titanium strip having a decorative surface appearance having homogeneous gloss. The reason why the above effect is obtained according to this embodiment is considered as follows.

Titanium ions are oxidative in nature and act to enhance the pickling speed. However, when its content exceeds a certain level, the ions serve to lower the pickling speed. The threshold value of the certain level is in the vicinity of 0.1 g/liter. Accordingly, it is considered that when the pickling is performed at a titanium concentration of less than 0.1 g/liter to 0 g/liter in a pickling solution, the pickling reaction is not stabilized, under which partial difference in the degree of pickling appears. This eventually leads to a difference in gloss. On the other hand, when the titanium ion concentration becomes too great in the pickling solution, the titanium ions considerably impede the pickling reaction, so that the pickling reaction is unlikely to proceed. Thus, the upper limit is preferably at 100 g/liter. It will be noted that the titanium ion concentration is preferably in the range of about 2 to 80 g/liter.

It has also been found that when a titanium strip is subjected to pickling finish in a continuous annealing and pickling line or in a pickling line wherein an content of oxygen in an annealing furnace atmosphere is invariably controlled at not less than 1 vol %, there can be obtained a titanium strip having homogeneous gloss and a decorative surface appearance. When the oxygen concentration in the annealing furnace atmosphere is less than 1 vol %, very dense scale is formed, and cannot be completely removed through salt immersion, permitting the degree of pickling to be partially lessened in a subsequent pickling step to cause a difference in gloss. It is to be noted that the oxygen content in the furnace atmosphere should preferably be at 3 vol % for a lower limit and at 20 vol % (i.e. atmospheric oxygen content) for an upper limit.

For a method of controlling the oxygen concentration in the furnace atmosphere at the time of annealing, there is disclosed, for example, in Japanese Laid-open Patent Application No. 5-222558 a technique, wherein a furnace oxygen content is controlled within a range of 1 to 10 vol % for the annealing of austenitic stainless steels. However, it is stated in the application that this technique is given for the reason that when the oxygen content in the furnace is outside the above range, scale is formed as thick and is unlikely to be removed in subsequent pickling. In contrast, unlike stainless steels, the thickness of the scale formed on titanium is not dependent on the oxygen concentration, but on the temperature and time. More particularly, with titanium, a difficulty in scale removal depending on the oxygen concentration results from the nature of scale as mentioned above.

Moreover, we have found that when a titanium strip is subjected to pickling finish in a continuous annealing and pickling line or in a pickling line, it is effective to obtain a titanium strip having homogeneous gloss and a decorative surface appearance by a procedure, wherein when the degree of pickling is expressed by a loss in strip thickness after pickling, the pickling is effected at a degree of not less than 1 $\mu$m.

The reason why such an effect as mentioned above is obtained can be explained in view of the relation between the degree of pickling and the gloss (FIG. 4). As is particularly shown in FIG. 4, a region where the degree of pickling is less than 1 $\mu$m is one where the gloss abruptly changes due to the pickling. Thus, a slight difference in the degree of pickling between the portions of the strip reflects on the difference in gloss. In contrast, with a region where the degree of pickling is not less than 1 $\mu$m, the gloss does not change abruptly by the influence of pickling. Thus, any appreciable difference in gloss does not result depending on the difference in the degree of picking, thereby ensuring homogeneous gloss of the strip.

The degree of pickling can be controlled depending on the immersion time of a titanium strip in a pickling vessel, and the concentration and temperature of a pickling solution. The upper limit of the degree of pickling is not critical, but too large a value is not practically beneficial. The upper limit is appropriately at about 2000 $\mu$m. It will be noted that a similar effect is obtained when a total degree of pickling is at the same level for the case where a titanium strip is passed plural times without annealing and for the case where the strip is passed only once.

Further, we have found that when a titanium strip is subjected to continuous pickling finish in a continuous annealing and pickling line wherein picking finish is performed after controlling an average grain size of the titanium strip within a range of 5 to 60 $\mu$m by controlling annealing conditions, there can be effectively obtained a titanium strip having homogeneous gloss and a decorative surface appearance.

When the average grain size is less than 5 $\mu$m, the macro structure of the material becomes conspicuous, resulting in uneven gloss. On the other hand, when the average grain size exceeds 60 $\mu$m, the strip assumes a mirror surface by pickling, so that minute waves of the material (edge waves and middle waviness) cause the material to be locally different in feeling of gloss.

Figure 5:
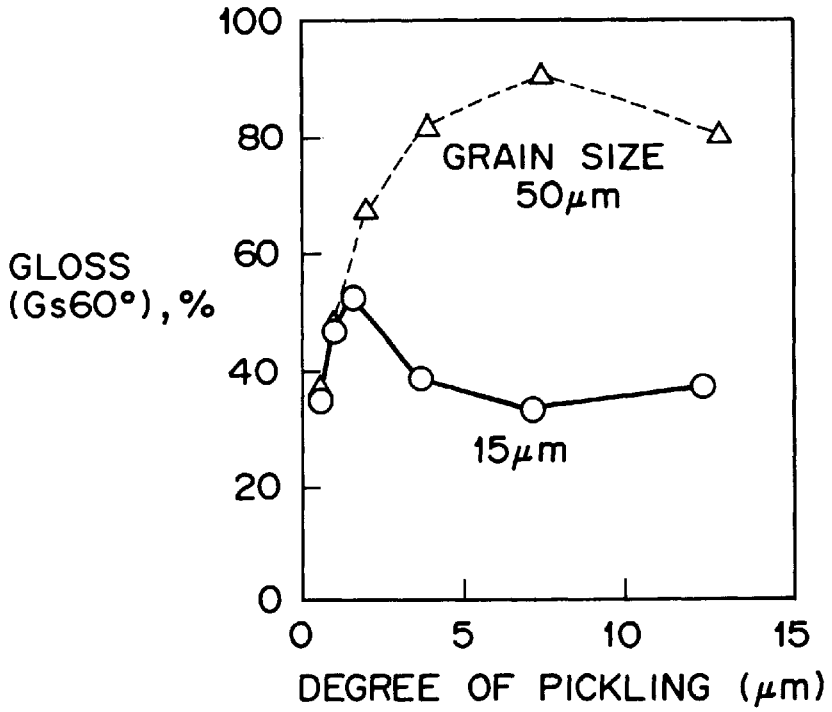
FIG. 5 is a graph showing the relation between the gloss and the degree of pickling for different grain sizes.

The influences of the degree of pickling and the average grain size on the gloss is shown in FIG. 5. As will be apparent from this figure, to control the degree of pickling and the average grain size within appropriate ranges, respectively, leads to an arbitrary control in level of gloss.

The invention is more particularly described by way of example, which should not be construed as limiting the invention thereto. It will be noted that many variations and alterations may be possible in the light of the details of arrangements of the invention described above and hereinafter without departing from the scope of the invention.

EXAMPLE 1

Figure 1:
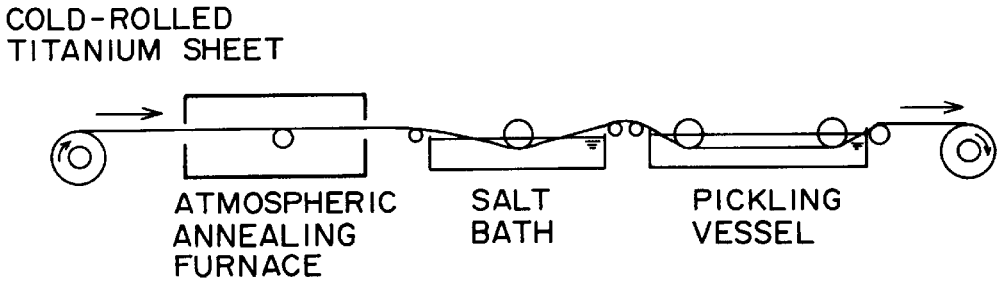
FIG. 1 is a schematic illustrative view showing a continuous annealing and pickling line.

In a continuous annealing and pickling line having such an arrangement shown in FIG. 1, a 1 mm thick pure titanium strip, as cold rolled, having the following specification was passed, one to five times, through the line under conditions indicated in Table 1. Whenever the strip was subjected to the passing cycle, the strip was turned invertedly so that the front and back sides of the titanium strip were inverted in the pickling vessel. More particularly, the strip was passed through the line plural times, at which the front and back sides of the coil were, respectively, turned to a ground side in the pickling vessel at least once. The front and back sides of the resultant coil after pickling were subjected to measurement of a gloss. The measurement of gloss was made according to the method described in JIS Z 8741, wherein the angle of incidence and a light-receiving angle were, respectively, set at 60°. It will be noted that the gloss was measured at the front and back surfaces of each coil (provided that the term "front surface" used herein means a surface which turns toward the ceiling side in the pickling vessel in the last passing cycle) at three points including top and rear ends of the coil and a center along the length thereof. The three points were each at a center along the width of the coil. Average values of the measurements at the three points were determined as glosses at the front and back sides, respectively. It will be noted that the case where a difference in gloss exceeds 10% is judged as a significant difference (i.e. as being not uniform).

The results are shown in Table 2. From Table 2, it will be seen that a difference in gloss between the front and back sides of the strip after one passing cycle is great, and that after two or more passing cycles, the difference in gloss between the front and back sides is at a level which is small enough for practical applications. As the passing cycle increases in number, the gloss comes close to a certain value.

These results reveal that when the strip is passed through the line plural time and the titanium strip is appropriately inverted in such a way that front and back sides of the strip are, respectively, turned to a ground side in the pickling vessel at least once, a titanium strip having homogeneous gloss on the surfaces thereof can be effectively manufactured.

TABLE 1

| | |
|---|---|
| Atmospheric annealing temperature | 720° C. |
| Atmospheric annealing time | 1.5 minutes |
| Salt temperature | 490° C. |
| Salt immersion time | 100 seconds |
| Pickling solution | 3 wt % HF + 10 wt % $HNO_3$ |
| Pickling temperature | 44° C. |
| Degree of pickling (sheet thickness) | 15 μm/cycle |

TABLE 2

| | Sheet Passing | Gloss (%) | | |
|---|---|---|---|---|
| No. | Cycle | Front Surface | Back Surface | Remarks |
| 1 | 1 | 70 | 40 | Comp. Ex. |
| 2 | 2 | 45 | 37 | Example |
| 3 | 3 | 38 | 37 | Example |
| 4 | 4 | 34 | 32 | Example |
| 5 | 5 | 32 | 33 | Example |

EXAMPLE 2

In the continuous annealing and pickling line having such an arrangement as shown in FIG. 1, two titanium strips having different widths were, respectively, passed through the line under conditions indicated in Table 3 below. The gloss at the surface of the respective titanium strips obtained after pickling was measured in the following manner. A preceding coil and succeeding coil were, respectively, subjected to measurement of gloss at three points including top and rear ends thereof and a center along the length thereof. The measured surface was at the front side and the measurement along the width was at a center of the coil. An average value of the three measurements of the preceding coil and an average value of the three measurements of the succeeding coil were, respectively, provided as glosses of the preceding and succeeding coils. The preceding strip was set at a width of 1 m.

The results are shown in Table 4. From Table 4, it will be seen that in Nos. 1 to 5, a difference in strip width between the two strips is within a range of not more than 50% of the width of a preceding strip, so that a difference in gloss between the two strips is small. In contrast, with Nos. 6 and 7, a difference in the strip width exceeds 50%, resulting in a great difference in gloss between both titanium strips.

From the above results, it will be appreciated that pickling finish should be performed in such a way that a difference in width between the successively passed titanium strips is within a range of not more than 50% of a preceding strip in order to effectively obtain a titanium strip having homogeneous gloss and a decorative surface appearance.

TABLE 3

| | |
|---|---|
| Atmospheric annealing temperature | 720° C. |
| Atmospheric annealing time | 1.5 minutes |
| Salt temperature | 490° C. |
| Salt immersion time | 100 seconds |
| Pickling solution | 3 wt % HF + 10 wt % $HNO_3$ |
| Pickling temperature | 44° C. |
| Degree of pickling (sheet thickness) | 15 μm/cycle |

TABLE 4

| | Sheet Width (m) | | Gloss (%) | | |
|---|---|---|---|---|---|
| No. | Preceding sheet | Succeeding sheet | Preceding sheet | Succeeding sheet | Remarks |
| 1 | 1 | 1 | 56 | 60 | Example |
| 2 | 1 | 1.2 | 50 | 55 | Example |
| 3 | 1 | 1.5 | 48 | 54 | Example |
| 4 | 1 | 0.7 | 50 | 54 | Example |
| 5 | 1 | 0.5 | 45 | 49 | Example |
| 6 | 1 | 1.6 | 50 | 80 | Comp. Ex. |
| 7 | 1 | 0.4 | 48 | 24 | Comp. Ex. |

EXAMPLE 3

In the continuous annealing and pickling line having such an arrangement as shown in FIG. 1, the titanium concentration in a pickling solution was broadly changed, and titanium strips were passed under conditions indicated in Table 5. The coils obtained after pickling were, respectively, checked with respect to the presence or absence of irregularities of gloss on their surfaces (i.e. a local difference of a gloss). The gloss irregularities were evaluated by measuring a gloss at a portion whose gloss is locally observed as different from other portions and a gloss at its surrounding portion with uniform gloss according to the procedure set out hereinbefore. When the difference between the measurements of the gloss exceeds 10%, it can be judged that the strip has gloss irregularities.

The results are shown in Table 6. From the results, it will be seen that in Nos. 1 to 5, the titanium ion concentration is within an appropriate range of 0.1 to 100 g/liter, no occurrence of gloss irregularities was recognized. In contrast, in Nos. 6 to 8, the titanium ion concentration is outside the above range, resulting in the occurrence of gloss irregularities.

From these results, it will be appreciated that when the titanium ion concentration in a pickling solution is kept within a range of 0.1 to 100 g/liter, there can be effectively, obtained a titanium or titanium alloy coil having a decorative surface appearance.

TABLE 5

| | |
|---|---|
| Atmospheric annealing temperature | 800° C. |
| Atmospheric annealing time | 1 minute |
| Oxygen content in annealing furnace | 5 vol % |
| Salt temperature | 500° C. |
| Salt immersion time | 90 seconds |
| Pickling solution | 2 wt % HF + 10 wt % $HNO_3$ |
| Pickling temperature | 40° C. |
| Degree of pickling (sheet thickness) | 20 μm |

TABLE 6

| No. | Titanium ion concentration (g/litter) | Presence or absence of gloss irregularities | Difference in gloss (%) | Remarks |
|---|---|---|---|---|
| 1 | 0.1 | No | 10 | Example |
| 2 | 2 | No | 7 | Example |
| 3 | 50 | No | 7 | Example |
| 4 | 80 | No | 7 | Example |
| 5 | 100 | No | 9 | Example |

TABLE 6-continued

| No. | Titanium ion concentration (g/litter) | Presence or absence of gloss irregularities | Difference in gloss (%) | Remarks |
|---|---|---|---|---|
| 6 | 0 | Yes | 21 | Comp. Ex. |
| 7 | 105 | Yes | 19 | Comp. Ex. |
| 8 | 130 | Yes | 19 | Comp. Ex. |

EXAMPLE 4

In the continuous annealing and pickling line having such an arrangement as shown in FIG. 1, the oxygen concentration in an annealing furnace were broadly changed, and coils were passed under conditions indicated in Table 7. The titanium strips obtained after pickling were, respectively, checked with respect to the presence or absence of irregularities of gloss on their surfaces in the same manner as in Example 3.

The results are shown in Table 8. From the results, it will be seen that in Nos. 1 to 4, the oxygen concentration is not less than 1%, so that no gloss irregularities occur. In contrast, with Nos. 5 and 6, the oxygen concentration is as low as less than 1%, gloss irregularities occur.

From these results, when the oxygen concentration in the annealing furnace is kept within a range of at least 1%, there can be effectively manufactured a titanium strip having homogeneous gloss and a decorative surface appearance.

TABLE 7

| | |
|---|---|
| Atmospheric annealing temperature | 700° C. |
| Atmospheric annealing time | 2 minutes |
| Oxygen content in annealing furnace | 0.1 to 15 vol % |
| Salt temperature | 500° C. |
| Salt immersion time | 110 seconds |
| Pickling solution | 2 wt % HF + 15 wt % $HNO_3$ |
| Pickling temperature | 48° C. |
| Degree of pickling (sheet thickness) | 25 $\mu$m/cycle |

TABLE 8

| No. | Oxygen content in annealing furnace | Presence or absence of gloss irregularities | Difference in gloss (%) | Remarks |
|---|---|---|---|---|
| 1 | 1 | No | 9 | Example |
| 2 | 4 | No | 6 | Example |
| 3 | 10 | No | 7 | Example |
| 4 | 15 | No | 7 | Example |
| 5 | 0.5 | Yes | 19 | Comp. Ex. |
| 6 | 0.1 | Yes | 18 | Comp. Ex. |

EXAMPLE 5

In the continuous annealing and pickling line having such an arrangement as shown in FIG. 1, the oxygen concentration in an annealing furnace were broadly changed, and coils were passed under conditions indicated in Table 7. The titanium strips obtained after pickling were, respectively, checked with respect to the presence or absence of irregularities of gloss on their surfaces in the same manner as in Example 3.

The results are shown in Table 10. From the results, it will be seen that in Nos. 1 to 6, the degree of pickling was not less than 1 $\mu$m, so that no occurrence of gloss irregularities were found. In contrast, in Nos. 7 and 8, the degree of pickling was outside the range, gloss irregularities were found.

From there results, it will be appreciated that when line was operated such that the degree of pickling was not less than 1 $\mu$m when expressed as a loss in strip thickness, there can be effectively manufactured a titanium strip having homogeneous gloss and a decorative surface appearance.

TABLE 9

| | |
|---|---|
| Atmospheric annealing temperature | 700° C. |
| Atmospheric annealing time | 1.5 minutes |
| Oxygen content in annealing furnace | 3 vol % |
| Salt temperature | 490° C. |
| Salt immersion time | 90 seconds |
| Pickling solution | 2 wt % HF + 10 wt % $HNO_3$ |
| Pickling temperature | 45° C. |
| Degree of pickling (sheet thickness) | 0.5 to 200 $\mu$m |

TABLE 10

| No. | Degree of pickling ($\mu$m) | Presence or absence of gloss irregularities | Difference in gloss (%) | Remarks |
|---|---|---|---|---|
| 1 | 1 | No | 9 | Example |
| 2 | 20 | No | 7 | Example |
| 3 | 40 | No | 10 | Example |
| 4 | 60 | No | 9 | Example |
| 5 | 100 | No | 9 | Example |
| 6 | 200 | No | 10 | Example |
| 7 | 0.1 | Yes | 28 | Comp. Ex. |
| 8 | 0.5 | Yes | 19 | Comp. Ex. |

EXAMPLE 6

In the continuous annealing and pickling line having such an arrangement as shown in FIG. 1, the annealing temperature was broadly changed to change a grain size in titanium strips, and coils were passed under conditions indicated in Table 11. The titanium strips obtained after pickling were, respectively, checked with respect to the presence or absence of irregularities of gloss on their surfaces in the same manner as in Example 3.

The results are shown in Table 12. From the results, it will be seen that in Nos. 1 to 5, the grain size was within a range of 5 to 60 $\mu$m, so that no occurrence of gloss irregularities were found. In contrast, in Nos. 6 to 8, the grain size was outside the above range, gloss irregularities were found. It will be note that in Nos. 7 and 8, the difference in gloss is less than 10%, but when visually observed, minute waves of the strip were felt as a difference in gloss.

From there results, it will be appreciated that to keep the grain size within a range of 5 to 60 $\mu$m is effective in manufacturing a titanium strip having homogeneous gloss and a decorative surface appearance.

TABLE 11

| | |
|---|---|
| Atmospheric annealing temperature | 600 to 900° C. |
| Atmospheric annealing time | 1.5 minutes |
| Oxygen content in annealing furnace | 6 vol % |
| Salt temperature | 510° C. |
| Salt immersion time | 90 seconds |
| Pickling solution | 2 wt % HF + 10 wt % $HNO_3$ |
| Pickling temperature | 40° C. |
| Degree of pickling (sheet thickness) | 20 $\mu$m |

TABLE 12

| No. | Grain size (μm) | Presence or absence of gloss irregularities | Difference in gloss (%) | Remarks |
|---|---|---|---|---|
| 1 | 5 | No | 8 | Example |
| 2 | 20 | No | 7 | Example |
| 3 | 30 | No | 8 | Example |
| 4 | 40 | No | 9 | Example |
| 5 | 60 | No | 10 | Example |
| 6 | 2 | Yes | 22 | Comp. Ex. |
| 7 | 70 | Yes | 9 | Comp. Ex |
| 8 | 80 | Yes | 10 | Comp. Ex. |

EXAMPLE 7

Figure 6:
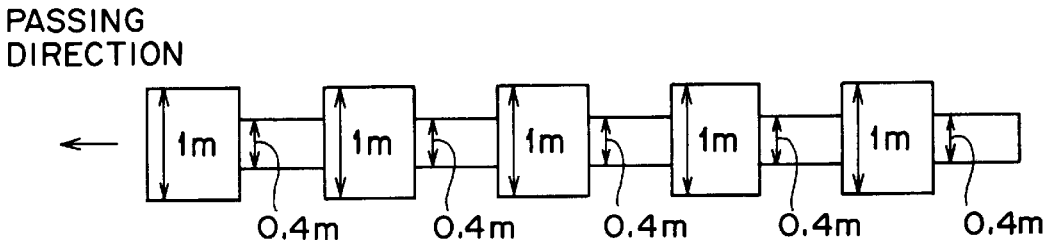
FIG. 6 is a view illustrating the state of connecting ten seccesssive coils in a continuous annealing and pickling line.

In the continuous annealing and pickling line having such an arrangement as shown in FIG. 1, as-cold-rolled pure titanium strips (coils) having a thickness of 1 mm and an overall length of 100 m were continuously passed through the line under conditions A to Y indicated in Table 13 wherein ten coils were used for individual conditions. The preceding coils and succeeding coils, which, respectively, had different widths indicated in Table 13, were alternately connected to provide continuous ten coils. An instance of the case using strip passing conditions A is shown in FIG. 6. The titanium strips obtained after pickling were, respectively, evaluated with respect to the surface gloss in the following manner. Moreover, the other passing conditions are shown in Table 14. It will be noted that atmospheric annealing indicated in Table 14 is carried out only at an initial cycle of strip passage.

[Evaluation method of gloss]

(Strip passing conditions A to G)

The front and back surfaces of each coil (provided that the term "front surface" used herein means a surface which turns toward the ceiling side in the pickling vessel in the last passing cycle) were, respectively, subjected to measurement of gloss at intervals of 5 m at the center as viewed from the direction of the strip width. Twenty measurements at the surface side and twenty measurements at the back side were compared with each other, and a maximum difference therebetween was determined as a difference of gloss between the opposite sides of coils. With respect to this gloss difference, an average value of the differences of 10 coils in total was calculated and indicated as difference of gloss in Table 13.

(Strip passing conditions H to N)

The gloss at the center along the strip width was measured at intervals of 5 m with respect to the front surface of each coil, and measurements of two coils being passed in sequence, i.e. 20 measurements of a preceding coil and 20 measurements of a succeeding coil, were compared with each other. A maximum value of the difference therebetween was determined as a difference of gloss. An average value of 9 measurements was calculated and is indicated as difference of gloss in Table 13.

(Strip passing conditions O to U)

The gloss at a center along the strip width was measured at intervals of 5 m with respect to the front surface of each coil. A maximum value of 20 measurements was determined as a difference of gloss for each coil. With respect to this gloss difference, an average value of the differences of 10 coils in total was calculated and indicated as difference of gloss in Table 13.

(Strip passing conditions V to Y)

With respect to the front and back surfaces of each coil, the gloss at the center along the width thereof was measured at intervals of 5 m, and measurements of 10 coils in total were compared irrespective of the front and back surfaces and individual coils. The maximum difference of the gloss was indicated as difference of gloss in Table 13. These results are all shown in table 13 below.

TABLE 13

| Sheet passing conditions | Passing cycle | Width of preceding Coil (m) | Width of succeeding coil (m) | Titanium ion concentration (g/liter) | Oxygen content in furnace (vol %) | Difference of gloss (%) |
|---|---|---|---|---|---|---|
| A | 2 | 1 | 0.4 | 0 | 5 | 4 |
| B | 4 | 1 | 0.4 | 0 | 5 | 5 |
| C | 2 | 1 | 0.4 | 0 | 15 | 5 |
| D | 4 | 1 | 0.4 | 0 | 15 | 4 |
| E | 1 | 1 | 0.4 | 0 | 5 | 7 |
| F | 1 | 1 | 0.4 | 0 | 15 | 6 |
| G | 1 | 1 | 0.4 | 0 | 0.5 | 18 |
| H | 1 | 1 | 1 | 0 | 5 | 5 |
| I | 1 | 1 | 0.7 | 0 | 5 | 5 |
| J | 1 | 1 | 1 | 0 | 15 | 3 |
| K | 1 | 1 | 0.7 | 0 | 15 | 5 |
| L | 1 | 1 | 0.4 | 0 | 5 | 7 |
| M | 1 | 1 | 0.4 | 0 | 15 | 8 |
| N | 1 | 1 | 0.4 | 0 | 0.5 | 23 |
| O | 1 | 1 | 0.4 | 2 | 5 | 6 |
| P | 1 | 1 | 0.4 | 2 | 5 | 5 |
| Q | 1 | 1 | 0.4 | 80 | 15 | 4 |
| R | 1 | 1 | 0.4 | 80 | 15 | 4 |
| S | 1 | 1 | 0.4 | 0 | 5 | 4 |
| T | 1 | 1 | 0.4 | 0 | 15 | 5 |
| U | 1 | 1 | 0.4 | 0 | 0.5 | 20 |
| V | 2 | 1 | 1 | 2 | 2 | 2 |
| W | 2 | 1 | 1.2 | 10 | 6 | 2 |
| X | 3 | 1 | 0.8 | 50 | 8 | 2 |
| Y | 3 | 1 | 1.5 | 80 | 15 | 2 |

TABLE 14

| | |
|---|---|
| Atmospheric annealing temperature | 735° C. |
| Atmospheric annealing time | 2 minutes |
| Grain size (intended) | 15 μm |
| Salt temperature | 500° C. |
| Salt immersion time | 60 seconds |
| Pickling solution | 2.3 wt % HF + 9 wt % $HNO_3$ |
| Pickling temperature | 45° C.7 |
| Degree of pickling (intended) | 15 μm (sheet thickness)/one cycle |

From the above result, it will be seen that with the samples obtained under strip passing conditions A to D where the coil was appropriately inverted and the oxygen content in the furnace was set within an appropriate defined range, the gloss difference is smaller than those of the samples obtained under passing conditions E and F wherein only the oxygen content in the furnace was set within the defined range and under passing conditions G where both requirements were not satisfied.

The samples obtained under passing conditions H to K where a difference in width between the preceding coil and succeeding coil was set at not more than 50% of the width of the preceding width and the oxygen content in the furnace was appropriately set within the defined range are smaller in difference of gloss than those samples obtained under passing conditions L and M where only the oxygen content in the furnace was appropriately set within the defined range and also under conditions N where both requirements were not satisfied.

The samples obtained under passing conditions O to R where the titanium ion concentration in the pickling solution was appropriately set within the defined range and the oxygen content in the furnace was appropriately set within the defined range are smaller in difference of gloss than those samples obtained under conditions S and T where only the oxygen content in the furnace was appropriately set within the defined range and also under conditions U where both requirements were not satisfied.

With the samples obtained under passing conditions V to Y where all the requirements defined in the present invention were satisfied, it will be seen that a variation of gloss can be successfully suppressed to a level of not more than 3% or below throughout the measured portions of ten coils.

As will be appreciated from the foregoing, in the pickling finish of a titanium or titanium alloy strip or coil in a continuous annealing and pickling line or in a pickling line alone, there has been established, according to the invention, a method wherein a gloss is made homogeneous or uniform between different titanium strips or throughout the same titanium strip and a gloss level can be arbitrarily controlled, if necessary.

What is claimed is:

1. A method for making a titanium or titanium alloy strip having homogeneous gloss and a decorative surface appearance, which comprises pickling a titanium or titanium alloy strip in a continuous annealing and pickling-line or a pickling line, wherein said titanium or titanium alloy strip is passed through a pickling vessel containing a pickling solution which has a titanium ion concentration of 0.1 to 100 g/liter plural times while inverting said strip in said pickling solution at least once during the plural times.

2. A method for making a titanium or titanium alloy strip having homogeneous gloss and a decorative surface appearance, which comprises pickling titanium or titanium alloy strips having different widths thereof in a continuous annealing and pickling line or a pickling line, wherein a succeeding strip of said titanium or titanium alloy has a difference in width of greater than zero and not more than 50% of the width of a preceding strip.

3. A method for making a titanium or titanium alloy strip having homogeneous gloss and a decorative surface appearance, which comprises annealing and pickling titanium or titanium alloy strips having different widths thereof in a continuous annealing and pickling line, wherein a succeeding strip of said titanium or titanium alloy has a difference in width of greater than zero and not more than 50% of the width of a preceding strip, and an annealing furnace in said continuous annealing and pickling line has an oxygen concentration of not less than 1 vol %.

4. A method for making a titanium or titanium alloy strip having homogeneous gloss and a decorative surface appearance, which comprises annealing and pickling a titanium or titanium alloy strip in a continuous annealing and pickling line comprising an annealing oven and a pickling vessel containing a pickling solution, wherein said pickling solution has a titanium ion concentration of 0.1 to 100 g/liter, and said annealing oven has an oxygen content of not less than 1 vol %.

5. A method for making a titanium or titanium alloy strip having homogeneous gloss and a decorative surface appearance, which comprises annealing and pickling titanium or titanium alloy strips having different widths thereof in a continuous annealing and pickling line comprising an annealing oven and pickling vessel, wherein said annealing and pickling comprises (a) to (d):

(a) passing said strips through a pickling vessel having an immersion roll plural times while inverting said strips in said vessel at least once during the plural times;

(b) a succeeding strip of said titanium or titanium alloy has a difference in width of not more than 50% of the width of a preceding strip;

(c) said pickling vessel contains a pickling solution having a titanium ion concentration of 0.1 to 100 g/liter; and (d) said annealing oven has an oxygen content of not less than 1 vol %.

6. A method according to claim 1, wherein said pickled titanium or titanium alloy strip has a degree of pickling of at least 1 μm.

7. A method according to claim 1, wherein said pickled titanium or titanium alloy strip has a degree of pickling of 1 to 2000 μm.

8. The method according to claim 4, wherein said pickled titanium or titanium alloy strip has a degree of pickling of at least 1 μm.

9. The method according to claim 4, wherein said pickled titanium or titanium alloy strip has a degree of pickling of 1 to 2000 μm.

10. A method according to claim 4, wherein the oxygen content in said annealing oven is 3 to 20 vol %.

11. A method according to claim 4, wherein said annealed titanium or titanium alloy strip has a grain size of 5 to 60 μm.

12. A method according to claim 2, wherein said continuous annealing and pickling line or pickling line comprises a pickling vessel containing a pickling solution which has a titanium ion concentration of 0.1 to 100 g/liter.

13. A method according to claim 2, wherein said pickled titanium or titanium alloy strip has a degree of pickling of at least 1 $\mu$m.

14. A method according to claim 2, wherein said pickled titanium or titanium alloy strip has a degree of pickling of 1 to 2000 $\mu$m.

15. A method according to claim 2, wherein said titanium or titanium alloy strip has a grain size of 5 to 60 $\mu$m.

16. A method according to claim 2, wherein the difference in width of the succeeding strip of said titanium or titanium alloy is between 20 and 50% of the width of the preceding strip.

* * * * *